US011565854B2

(12) United States Patent
Falzoni

(10) Patent No.: US 11,565,854 B2
(45) Date of Patent: Jan. 31, 2023

(54) CAP FOR A CONTAINER

(71) Applicant: SACMI COOPERATIVA MECCANICI IMOLA SOCIETA' COOPERATIVA, Imola (IT)

(72) Inventor: Alessandro Falzoni, Imola (IT)

(73) Assignee: SACMI COOPERATIVA MECCANICI IMOLA SOCIETA' COOPERATIVA, Imola (IT)

( * ) Notice: Subject to any disclaimer, the term of this patent is extended or adjusted under 35 U.S.C. 154(b) by 0 days.

(21) Appl. No.: 17/581,347

(22) Filed: Jan. 21, 2022

(65) Prior Publication Data

US 2022/0234790 A1 Jul. 28, 2022

(30) Foreign Application Priority Data

Jan. 26, 2021 (IT) ..... 102021000001430

(51) Int. Cl.
*B65D 41/34* (2006.01)
*B65D 51/16* (2006.01)

(52) U.S. Cl.
CPC ..... *B65D 41/3428* (2013.01); *B65D 51/1688* (2013.01)

(58) Field of Classification Search
CPC ..... B65D 41/3428; B65D 51/1688
(Continued)

(56) References Cited

U.S. PATENT DOCUMENTS 5,004,112 A * 4/1991 McBride ..... B65D 41/3428 215/252

5,050,753 A * 9/1991 Trump ..... B65D 41/3428 215/253

(Continued)

FOREIGN PATENT DOCUMENTS

EP 3521195 A1 8/2019
EP 3275801 B1 5/2020

*Primary Examiner* — James N Smalley
(74) *Attorney, Agent, or Firm* — Pearne & Gordon LLP; John P. Murtaugh

(57) ABSTRACT

What is described here is a closing cap (1) for a container (2), in particular for a container (2) intended to contain pressurised beverages. The cap comprising a lateral wall (3) extending around an axis (Z) and a transversal wall (4) positioned at one end of the lateral wall (3), a separating line (5) being provided on the lateral wall (3) to define a retaining ring (301), which extends as far as a free edge (304) and is configured to internally engage with a locking ring (206) of a neck (201) of the container (2), and a closing element (302) removably engageable with the neck, so as to open or close the container. The cap comprises an inner thread structure, positioned on the inside of the lateral wall (3) of the closing element (302) to engage with an outer thread structure of the neck (201) and to removably couple the closing element (302) to the neck (201) of the container (2). The inner thread structure (305) extends in a spiral around the axis (Z) and comprises at least two vent grooves (306) which extend axially and interrupt the inner thread structure (305) thereby defining first segments (307), near the transversal wall (4) and second segments (308), over which the first segments (307) are axially superposed; wherein each of the first segments (307) extends angularly in a continuous way and at least one segment of the second segments (308) is interrupted by a vent passage (309), to facilitate the discharge of the pressure.

12 Claims, 5 Drawing Sheets

(58) Field of Classification Search
USPC ..... 215/252, 307, 329
See application file for complete search history.

(56) References Cited

U.S. PATENT DOCUMENTS

| | | | | | |
|---|---|---|---|---|---|
| 5,205,426 | A * | 4/1993 | McBride | B65D 41/3428 | 215/252 |
| 5,320,234 | A * | 6/1994 | Kamath | B65D 41/3409 | 215/252 |
| 5,485,374 | A * | 1/1996 | Takaku | F02D 41/22 | 701/111 |
| 5,501,349 | A * | 3/1996 | McCandless | B65D 41/3442 | 215/252 |
| 6,089,390 | A | 7/2000 | Druitt et al. | | |
| 6,325,225 | B1 | 12/2001 | Druitt et al. | | |
| 9,902,530 | B2 * | 2/2018 | Smith | B65D 41/3447 | |
| 2002/0030031 | A1 | 3/2002 | Druitt et al. | | |
| 2019/0161247 | A1 * | 5/2019 | Dreyer | B65D 41/0407 | |

* cited by examiner

CAP FOR A CONTAINER

This invention relates to a cap for a container.

In particular, the invention relates to a cap which is particularly, but not exclusively, suitable for containers, for example bottles, intended to contain liquid substances which are pressurised or aerated, that is to say, carbonated, or which could generate carbon dioxide during a period of storage after production.

There are prior art caps for containers comprising a cup-shaped body provided with a transversal wall and with a lateral wall extending around an axis, which are typically made of plastic material and are provided with a separating line made in the lateral wall to define a retaining ring and a closing element, removably engageable with the neck, so as to open or close the container. The retaining ring can be configured to remain anchored to a neck of the container. The closing element is provided with an inner thread structure, suitable for engaging with an outer thread structure of the neck, which extends around the axis in a spiral to allow the cap on the neck to be unscrewed and screwed back on.

Along the separating line the breakable bridges are present, which are intended to be broken the first time the cap is opened. Indeed, when the cap is opened for the first time and is unscrewed from the neck of the container, the closing element separates from the retaining ring along the separating line as a result of the breaking of the breakable bridges and in this way the retaining ring can remain joined to the neck of the bottle, whilst the closing element can be separated from the container. Subsequently, the cup-shaped body can be screwed back onto the neck, to reclose the container and to bring the container back to a closed condition.

The separating line can be produced by cutting, or during moulding of the cap, and the shape of the separating line determines the way in which the closing element and the retaining ring separate as a result of cap opening for the first time.

For example, there are prior art caps in which the separating line is configured to extend circumferentially for the whole lateral wall in such a way that the closing element completely detaches from the retaining ring, at the moment when the cap is opened for the first time. Remaining connected to the neck, the retaining ring indicates to the user that the cap has been opened.

There are also prior art caps in which the separating line is configured in such a way that the retaining ring remains connected to the closing element, after the first opening, and can be removed together with it.

There are also other prior art caps in which the separating line is circumferentially interrupted to leave the closing element and the retaining ring joined in the cap open condition. In this case, the separating line extends between a first end and a second end which between them define a joining zone between the closing element and the retaining ring. After the first opening of the cap, the closing element remains connected to the retaining ring and both remain connected to the neck of the bottle and a user can rotate or move the closing element, when it is disengaged from the neck, between an open condition, to access the contents of the container, and a closed condition, in which the closing element prevents access to the container.

The cap can be made for example by moulding a polymeric material, for example compression moulding or injection moulding.

The inner thread structure of the cap can comprise a single thread, or a plurality of threads, each thread wound in a spiral axially around an axis of the cap from a start, positioned near the transversal wall, as far as an end, positioned near the separating line and similarly, the outer thread structure of the neck can also comprise a single thread, or a plurality of threads, wound in a spiral around an axis of the neck.

The plastic caps, like those described above, are widely used to close containers intended to contain aerated beverages, or in any case products which are pressurised or are pressurisable over time (for example fermentable beverages), but, in the case of use for pressurised products, such caps and the necks of such containers are suitably designed.

Indeed, a user can safely remove a cap from the container only if a residual pressure of the gas inside the container, before the inner thread structure of the cap has completely disengaged from the outer thread structure of the neck, is null, or in any case minimal. Indeed, if it were not null, or in any case minimal, that residual pressure could cause a violent ejection of the cap from the neck and therefore there could be damage to any objects hit, or even worse, injury to the user if the latter were hit.

For that purpose, the plastic caps for pressurised products and the necks of the containers intended to contain such products are specially configured to facilitate venting and gradual release of the pressure of the gas present inside the container during removal of the cap itself. Both the inner thread structure of the cap, and the outer thread structure of the neck, are respectively provided with a plurality of vent grooves and a plurality of vent channels which extend axially and which pass through and interrupt the respective threads.

In this way, the gas present inside the container can discharge through the vent grooves and the vent channels, even when the inner thread structure is still engaged by the outer thread structure, to guarantee a gradual release of the gas itself. In particular, when a vent groove of the cap faces a vent channel of the neck, preferential zones are created for the discharge of the pressurised gas from the container which speed up the discharge of the gas itself.

In order to increasingly limit the consumption of plastic, and therefore the environmental impact due to such consumption, caps for aerated beverages are spreading on the market which have a smaller height and diameter than those used up to now, so as to reduce the weight of the plastic material used for each cap.

These caps, being lower and narrower than those used up to now, leave a free space between an inner surface of the cap and an outer surface of the neck which is smaller than a same value measured for the caps used up to now. For example, a pitch between superposed parts of the thread structure can be smaller in an axial direction, and a distance between a crest of the thread and the outer surface of the neck can be smaller in a direction transversal to the axis.

For these types of caps, as a consequence of the reduction of the free space between the cap and the neck of the container, it is difficult for the pressurised gas to discharge from the container.

Although it is possible to increase the number of vent grooves in the cap, so as to increase said free space, that is not always advisable. Indeed, the thread structure acts as a rib which stiffens, and therefore strengthens, the closing element, preventing the latter from being able to deform by expanding when the pressure increases. Reducing the thread structure could result in sudden disengagement of the inner thread structure of the neck from the outer thread structure of the cap. In such conditions, the pressure inside the container could cause violent ejection of the cap despite the increase in the number of vent grooves.

One aim of the invention is to improve the prior art type of caps for a container, particularly caps for containers suitable for containing pressurised beverages, which comprise an inner thread structure intended to couple with an outer thread structure of the neck, in which the inner thread structure of the cap comprises at least two vent grooves to guarantee a gradual release of the pressure contained in the container.

Another aim is to supply a cap for a container suitable for containing pressurised beverages, which allows the pressurised gas to be effectively discharged when the cap is unscrewed from the neck without impairing the force with which the cap is kept joined to the neck.

Those aims and others are achieved by a cap for a container according to claim 1 and the claims dependent on it.

Further features and advantages of the invention will be apparent from the description which follows with reference to the accompanying drawings, which are supplied by way of example only and are non-limiting, in which.

With reference to the appended FIGS. 1 to 6, the numeral 1 denotes a cap for closing a container 2, in particular a bottle intended to contain a liquid substance such as a beverage.

In particular, the container 2 can be intended to contain beverages which are pressurised, that is to say, carbonated, or beverages which could generate carbon dioxide during a period of storage after production.

It should be noticed that, in this description, identical components will be labelled with the same reference numbers.

The cap 1 is made of polymeric material. Any polymeric material suitable for moulding can be used to obtain the cap 1.

Figure 1:
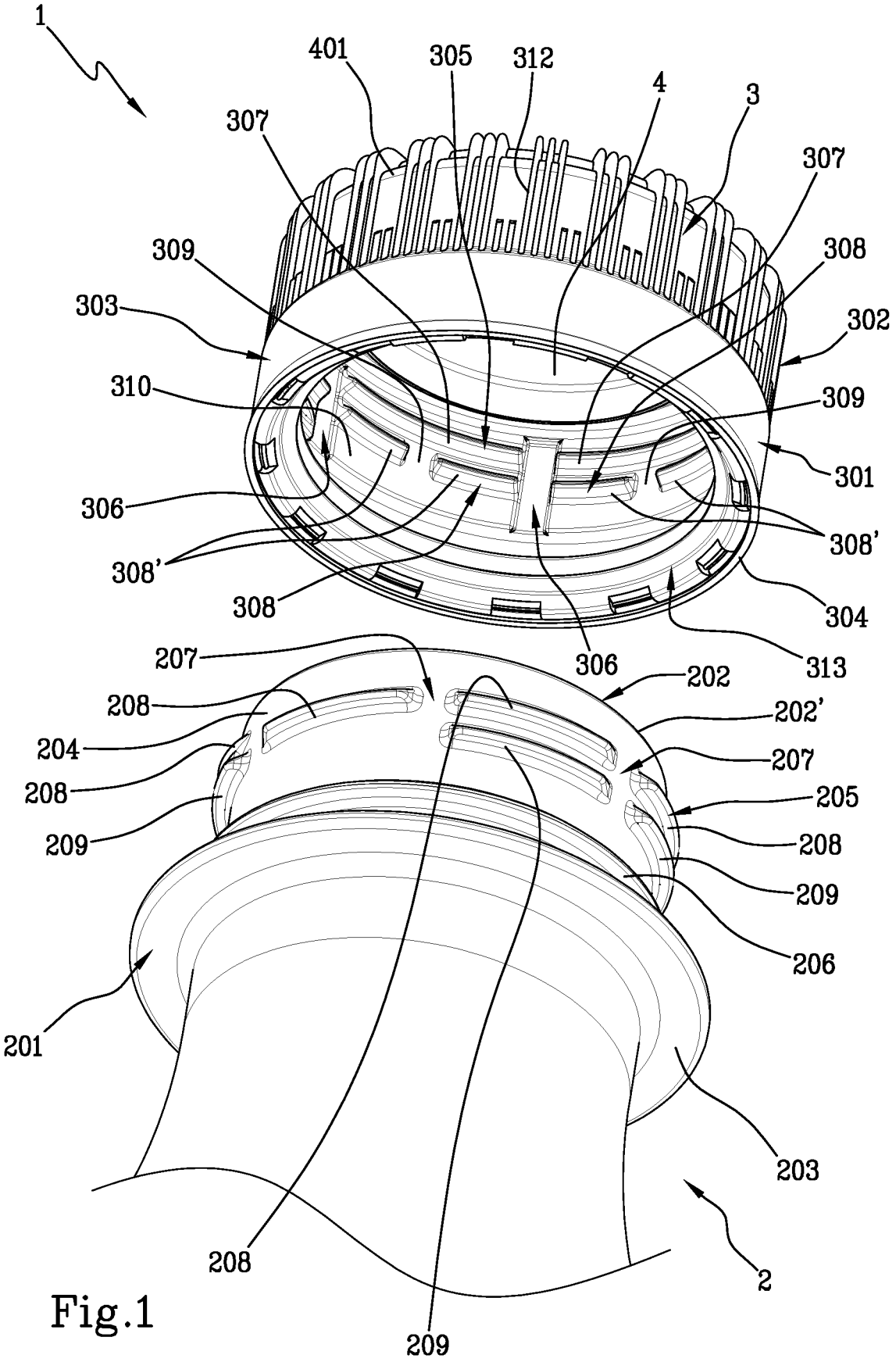
FIG. 1 is an axonometric view of a container for pressurised beverages of the prior art type and of a cap according to the invention intended to be applied on a neck of the container, in which an inner thread structure of the cap is configured to engage with an outer thread structure of a neck of the container.
Figure 2:
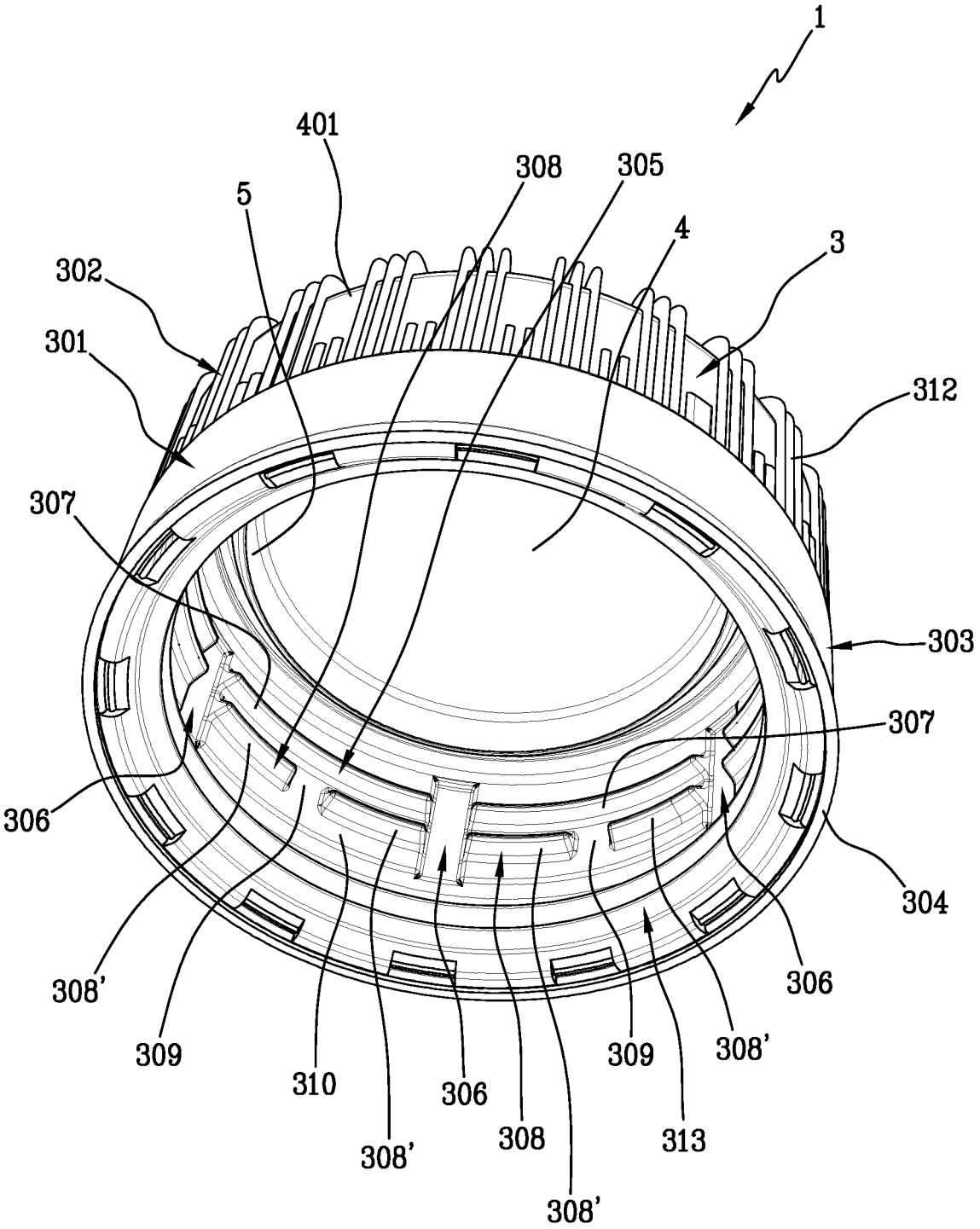
FIG. 2 is an axonometric view of the cap of FIG. 1.
Figure 3:
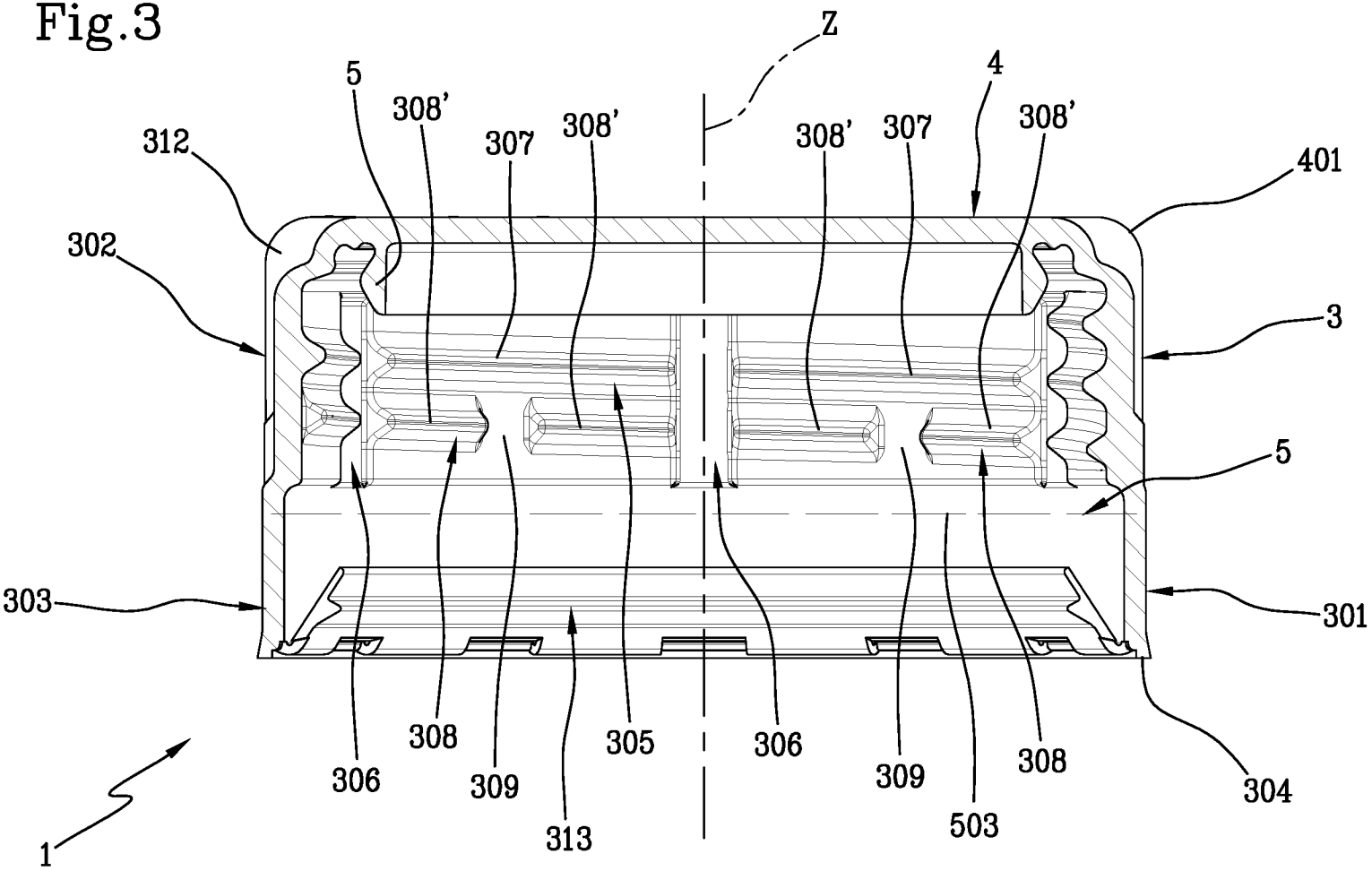
FIG. 3 is a cross-section view of the cap of FIG. 1.
Figure 5:
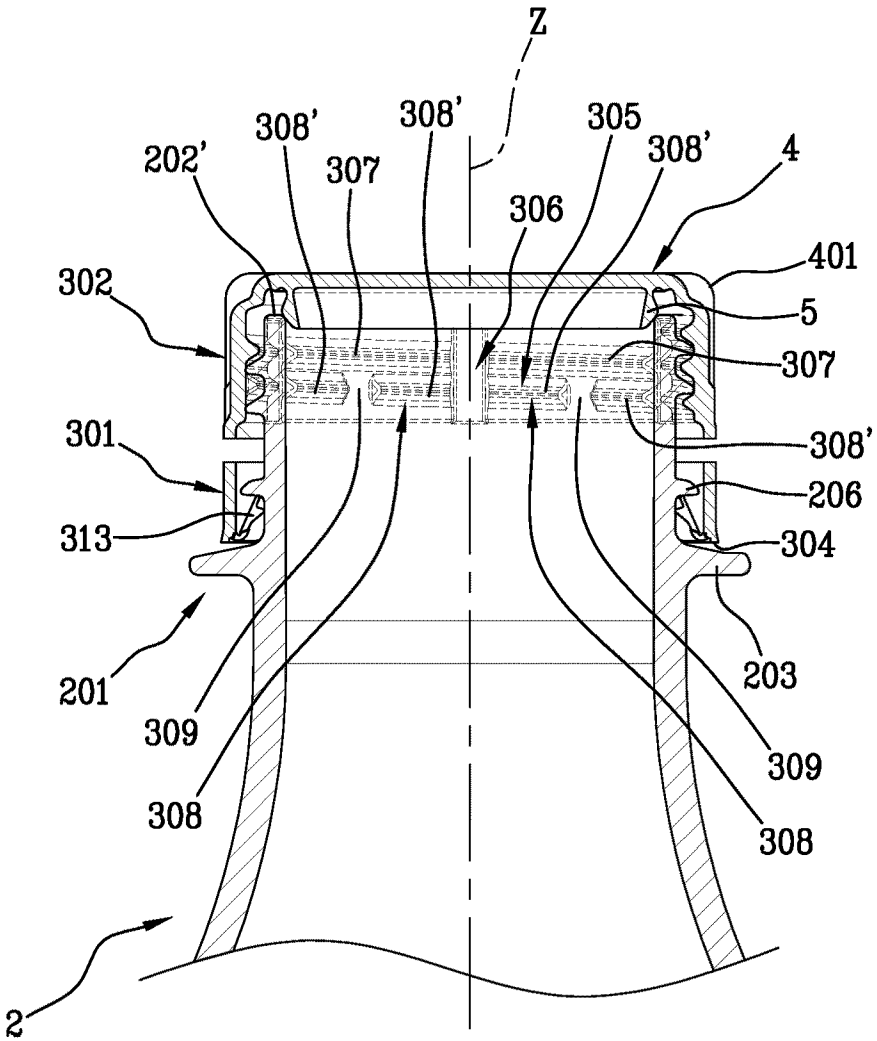
FIG. 5 is a cross-section view of the packaging of FIG. 3, when the cap has already been opened for the first time and the inner thread structure of the cap is partially disengaged from the outer thread structure of the neck.
Figure 4:
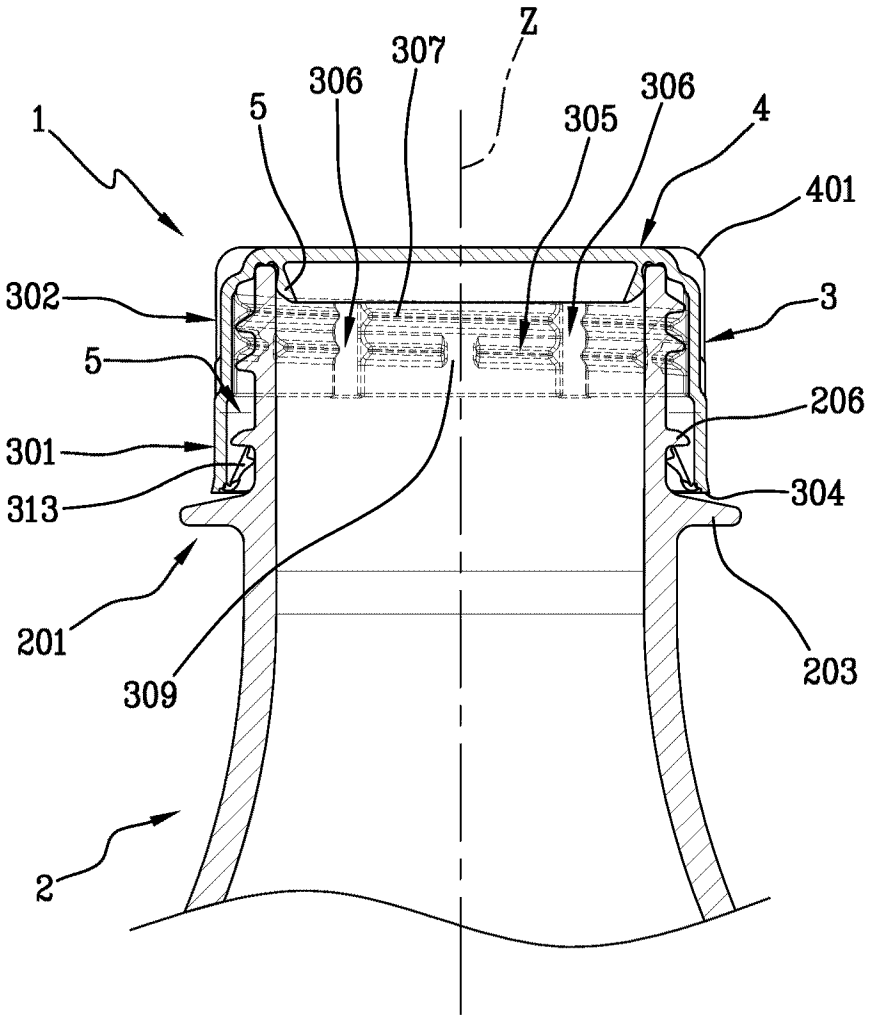
FIG. 4 is a cross-section view of packaging comprising the cap and the container of FIG. 1, when the cap is applied to the container and is in the closed condition.

The cap 1 is shown in FIGS. 1 to 3 in a condition in which the cap 1 is found when it leaves a cap production line and can be applied to a neck 201 of the container 2, in combination with it, as illustrated in FIGS. 4 and 5, which show a packaging comprising the cap 1 applied to the container 2, on the neck 201.

The cap 1 comprises a lateral wall 3 which extends around an axis Z, and a transversal wall 4 positioned at one end of the lateral wall 3, so as to close that end. The transversal wall 4 extends transversally, in particular perpendicularly, to the axis Z.

The axis Z is a central axis, of symmetry for the cap 1 and is also a central axis of symmetry for the neck 201 of the container 2, when the cap 1 is applied to it The transversal wall 4 can be flat, even though other shapes are theoretically possible. In the example shown, the transversal wall 4 has a substantially circular shape in plan view.

The lateral wall 3 and the transversal wall 4 define a cup-shaped body, suitable for receiving an end portion of the neck 201 of the container 2, so that the cap 1 can close the container itself.

Figure 6:
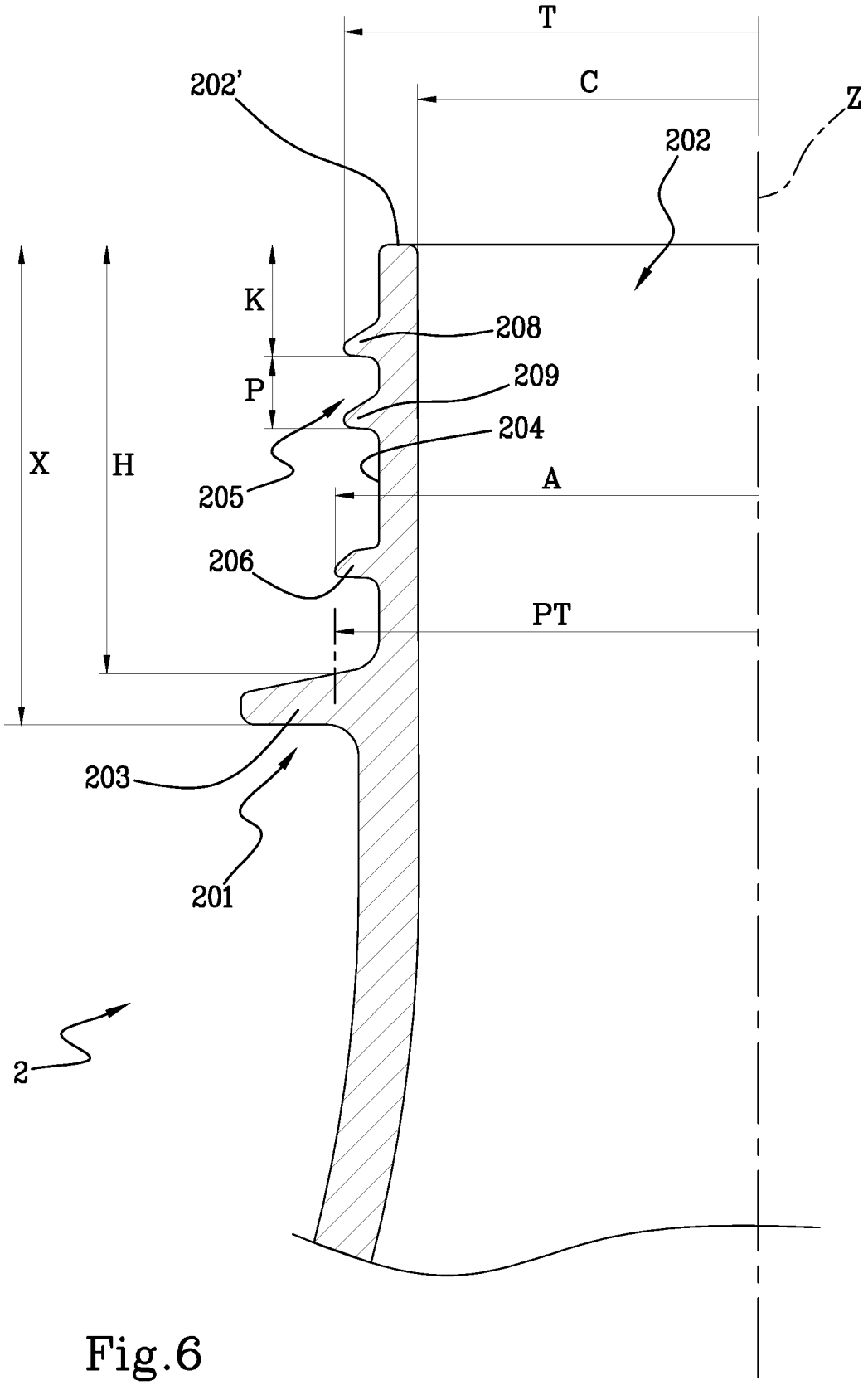
FIG. 6 is a cross-section view of the neck of the container of FIG. 1, in which several dimensions are indicated which identify significant parameters of the neck.

As shown in FIGS. 1 and 6, the neck 201 extends from a supply opening 202 to a supporting ring 203, configured to allow the container 2 to be supported during the production process for making the container 2 itself.

An upper edge 202' surrounds the supply opening 202.

It should be noticed that in this description the terms upper, or lower, above, or below, refer to a container 2 positioned vertically, in which the axis Z is therefore positioned vertically.

The neck 201 comprises an outer surface 204 from which an outer thread structure 205 for removably coupling the container 2 to the cap 1 protrudes.

The neck 201 also comprises a locking ring 206, positioned between the outer thread structure 204 and the supporting ring 203, which also protrudes from the outer surface 204 and is shaped to engage with the cap 1 during a passage from a closed condition to an open condition of the cap 1. The locking ring 206 is an annular protuberance which projects from the outer surface 204 of the neck 201 in a plane placed transversally to the axis Z.

The outer thread structure 205 comprises a single outer thread which extends angularly for an angle greater than 360° and less than 720° (for example between 620° and 710°) around the axis Z and has a plurality of vent channels 207 which interrupt said single thread and define first portions 208, near the upper edge 202', and second portions 209, positioned axially below the first portions 208. Therefore, said single outer thread extends, through the first portions 208 (which define a first turn of the thread) and the second portions 209 (which define a second turn of the thread) from a start, placed near the upper edge 202', to an end, placed near the locking ring 206.

As shown in FIG. 6, in the neck 201 it is possible to identify several characteristic sizes which can be used to define multiple different types of necks in dimensional terms, in accordance with specifications indicated at the end of the description.

T indicates the crest diameter of the outer thread structure, which corresponds to the crest diameter of the first portions 208 and/or of the second portions 209.

C indicates the internal diameter of the neck 201, at the upper edge 202'.

A indicates the diameter of the locking ring 206.

PT indicates the diameter of a point of the supporting ring 203 specified for the purpose of defining the geometric features of the neck 201 itself.

H indicates a height of the neck 201, considered starting from the axial dimension of the point PT.

X indicates a height of the neck 201, considered starting from a bottom of the supporting ring 203.

P indicates an axial distance between two portions of the outer thread structure 205 which are superposed, that is to say, the distance between one of the first portions 208 and the second portion 209 over which it is superposed, measured at an inner significant point of the first portion 208 and at a corresponding inner significant point of the second portion 209. In other words, P indicates the pitch P of the outer thread structure 205.

K indicates an axial distance between the upper edge 202' and the axial dimension of the inner significant point of the first portion 208.

For a more in-depth nomenclature relating to the characteristic sizes of the neck 201 of the container 2, and a more precise geometric definition, consult the specifications in ISBT Threadspecs™ (International Society of Beverage Technologists).

With reference to FIGS. 2 and 3, the lateral wall 3 of the cap 1 is connected to the transversal wall 4 by means of a connecting zone 401, which can be shaped, in cross-section, like a bevelled edge or a circular connector.

The cap 1 comprises a separating line 5, shown at least in FIG. 3, which is provided on the lateral wall 3 to define a retaining ring 301.

The separating line 5, on the lateral wall 3, defines not just the retaining ring 301, but also a closing element 302 removably engageable with the neck, so as to open or close the container. The closing element 302 is engageable to close the supply opening 202 of the container 2.

The retaining ring 301 comprises a retaining portion 303 which is configured to internally engage with the locking ring 206 of the neck 201 as a result of cap 1 opening for the first time.

The retaining portion 303 extends as far as a free edge 304 of the retaining ring 301, which delimits the retaining ring 301 on the opposite side to the transversal wall 4.

In other words, the retaining portion 303 is a lower portion of the retaining ring 301, and therefore of the cap 1, when the cap 1 is joined to the container 2.

As indicated below, in the cap 1 of FIGS. 1 to 5 the retaining ring 301 is configured to remain anchored to the neck 201 of the container 2 thanks to the retaining portion 303. However, in other types of caps, the retaining ring 301 can be configured to remain connected to the closing element 302, after the first opening, so that it can be removed together with it.

The lateral wall 3 can be provided, on an outer surface thereof, with a plurality of knurling lines 312, extending parallel to the axis Z and suitable for aiding gripping of the cap 1 by the user or by the capping machine which applies the cap 1 on the container 2 to be closed.

The knurling lines 312 can be positioned in the closing element 302 but can also continue in the connecting zone 401 and/or in the retaining ring 301.

In the example shown in FIGS. 1 to 5, it should be noticed that the lateral wall 3 has a cylindrical shape and extends from the connecting zone 401, on which the knurling lines 312 are made, as far as the free edge 304 of the retaining ring 301 with a practically constant diameter. The knurling lines are present in the closing element but are absent in the retaining ring 301. Without limiting the scope of the invention, the lateral wall 3 could also be shaped with portions having different diameters, for example the lateral wall 3 could comprise a cylindrical portion extending as far as the connecting zone 401, a widened portion with diameter greater than the cylindrical portion, which can extend as far as the free edge 304 of the retaining ring 301 and a connecting portion positioned between the cylindrical portion and the widened portion. The knurling lines 312 can be provided on the connecting surface but not in the widened portion, which is externally delimited by a smooth outer surface, that is to say, it can be free of knurling lines 312. However, that is not necessary, since the knurling lines 312 could also extend on the widened portion.

The separating line 5 can optionally be circumferentially interrupted, in a way not illustrated, to leave the closing element 302 and the retaining ring 301 joined in the cap 1 open condition. For example, the separating line 5, extending between a first end and a second end (not illustrated) which between them can define a joining zone between the closing element 302 and the retaining ring 301.

The lateral wall 3 can also comprise an incision line, not illustrated, which can be provided to define, together with the separating line 5, if the separating line 5 is interrupted, at least one connecting band for connecting the closing element 302 and the retaining portion 303 to each other, after the first opening of the cap 1.

The separating line 5 and the incision line can be made as cutting lines, by means of a cutting operation on a concave body obtained by means of moulding, which cutting lines can pass through the entire thickness of the lateral wall, or not pass through if the thickness of the lateral wall is to be only partially cut.

Preferably, the separating line 5 and the incision line (if present) are made by means of through cuts passing through an entire thickness of the lateral wall.

Optionally, along the separating line 5 there can be a plurality of breakable bridges 503, whilst along the incision line there can be a plurality of breakable elements, both being intended to break the first time the cap 1 is opened.

Preferably, the breakable bridges 503 are provided along the separating line 5 but not on the incision line.

As already indicated, the retaining ring 301 is configured to internally engage with the locking ring 206.

For that purpose, as shown at least in FIGS. 1 and 2, the retaining ring 301 is internally provided with an engaging element 313, suitable for engaging with the locking ring 206. The engaging element 313 is configured to abut against the locking ring 206 in order to prevent axial movements of the retaining ring 301, away from the neck 201, when the closing element 302 is moved away from the neck 201. In this way, during the first opening of the cap 1, the breakable bridges 503 are subjected to stress and can break.

In detail, it is the retaining portion 303 of the retaining ring 301 which is provided with the engaging element 313.

The engaging element 313 is shaped like an annular element which is bent around the free edge 304 inwards towards the inside of the retaining portion 303. In detail, the annular element can be continuous, as shown in FIGS. 1, 2 and 3, or can be interrupted, in a way not illustrated. Indeed, there can be a plurality of bent elements, not illustrated, shaped like tabs, which project from the free edge 304 and are bent inwards towards the inside of the retaining portion 303 to form the engaging element.

It should be noticed that the bent engaging element 313 can be formed by bending an end annular portion of the concave body obtained by means of moulding, before the cutting operation necessary to make the separating line 5, or optionally also the incision line, or after such cutting operations. Alternatively, according to one embodiment not illustrated, the engaging element 313 can be shaped like a continuous or interrupted protuberance, which from an inner surface of the retaining portion 303 projects towards the axis Z to engage with the locking ring 206.

The cap 1 shown in FIGS. 1 to 5 is configured so that the retaining ring 301, as a result of the first opening when the breakable bridges 503 of the separating line 5 break, remains anchored to the neck 201 and the closing element 302 completely separates from it, as shown in FIG. 5. In other words, the separating line 5 extends circumferentially for the whole lateral wall 3.

The cap 1 also comprises a sealing element 5, positioned concentric relative to the lateral wall 3, which extends towards the free edge 304 starting from the transversal wall 4 and is shaped in such a way that it is received in the supply opening 202 in order to form a seal with an inner surface of the neck 201.

As shown in FIGS. 1 to 5, the cap 1 additionally comprises an inner thread structure 305, positioned on the inside of the lateral wall 3 of the closing element 302 to removably couple the closing element 302 to the neck 201 of the container 2.

In detail, the inner thread structure 305 is intended to couple with the outer thread structure 205 of the neck 201.

The inner thread structure 305 extends in a spiral around the axis Z of the cap 1 and comprises at least two vent grooves 306 which extend axially and interrupt the inner thread structure 305 thereby defining first segments 307, near the transversal wall 4 and second segments 308, over which the first segments 307 are axially superposed.

The first segments 307 define a first turn and the second segments 308 define a second turn in the spiral inner thread structure 305. The axial distance between the first segments 307 and the second segments 308 which are superposed, measured at an inner significant point of one of the first segments 307 and one of the second segments 308, defines a pitch (not illustrated) of the inner thread structure 305.

According to the invention, each of the first segments 307 extends angularly in a continuous way and at least one segment of the second segments 308 is interrupted by a vent passage 309, to facilitate the discharge of the pressure. The vent passage 309 defines, in the interrupted segment of the second segments 308, at least one pair of parts 308'.

Preferably, the angular dimension of the vent passage 309 in the second segment is much smaller than the angular dimension of the vent groove 306. However, that is not necessary since the angular dimensions of the vent passage 309 can be equal to, or even greater than, the angular dimensions of the vent groove 306.

Thanks to this invention, all of the first segments 307 of the inner thread structure 305, which are subjected to more stress both during the time for which the container 2 is in the pressurised state, and when unscrewing the cap 1 from the neck 201 since they begin to engage with the outer thread structure of the neck when the container 2 is still pressurised, are continuous and guarantee sturdiness at the moment of greatest stress due to the maximum pressure inside the container 2.

At the same time, the presence of at least one of the second segments 308 in which the vent passage 309 is present, promotes the gradual discharge of the pressure from the container 2 and does not weaken the cap 1 itself, since the second segments 308 are subjected to stress by the pressure inside the container 2 when all of the first segments 309 have already disengaged and, therefore, most of the pressure has already been released.

Preferably, at least two of the second segments 308 are interrupted by respective vent passages 309.

Even more preferably, all of the second segments 308 are interrupted by respective vent passages 309. In this case, all of the second segments have at least one pair of parts 308', as shown at least in FIGS. 1 to 5.

Even if all of the second segments 308 are interrupted and have respective vent passages 309, to as far as possible promote and speed up the discharge of the pressure from the container 2, what was said above regarding the sturdiness of the engagement between the inner thread structure 305 and the outer thread structure 205 still applies. Indeed, the stress to which the second segments 308 are subjected is not capable of deforming the lateral wall 3 of the cap 1.

That guarantees an optimum cap 1 seal on the neck 201 during the engagement between the inner thread structure 305 and the outer thread structure 205 and a complete discharge of the pressure present inside the container 2 when the inner thread structure 305 of the cap is disengaged from the neck 201.

The inner thread structure 305 can comprise third segments, not illustrated, over which the second segments 308 are axially superposed; wherein at least one segment of the third segments can be interrupted by a respective vent opening, not illustrated, which can be axially aligned with the vent passage 309 of the second segment 308.

The third segments, if present, define a third turn in the spiral inner thread structure 305, which is positioned below the second turn defined by the second segments 308.

With the container closed, that is to say, the container 2 to which the cap 1 has been applied, the Applicant carried out a group of tests using aerated water with a CO2 level of between 4.5 vol (9 g/l of CO2) and 5.2 vol (10.5 g/l CO2) and using different methods to assess the performance of the cap 1 according to the invention, as regards the discharge of the gas before opening and the deformation of the cap over time as a result of the stress of the pressure.

In detail, in a first test, a test container was kept at the temperature of 22° C. for six weeks, to simulate storage at room temperature, and in a second test it was kept at the temperature of 38°, for a minimum of 2 weeks, to simulate storage at a high temperature. In a third test, the test container was subjected to a cyclical variation in temperature, for example: 6 hours at 60° C., 18 hours at 32° C. repeated 3 times, finally storage at 22° C. for one day, to simulate critical transportation conditions.

The cap was more stressed with the second and the third test at high temperature, since the stresses on the cap and neck increase as the pressure increases, but also due to the reduced mechanical properties of the plastic which with the increase in temperature loses stiffness (the modulus of elasticity decreases).

The tightness test highlighted the fact that no gas leaks occurred after the high temperature thermal cycle, other than those normally attributable to expansion of the container 2 and to permeation through the walls of the container 2 itself.

The visual inspection of deformation highlighted that, when the pressure is at its peak, the cap 1 deforms and the transversal wall 4 of the cap adopts a dome-like shape but the cap 1 remains stably joined on the neck 201.

In addition to this visual inspection, the cap 1 and the container were subjected to a tomography scan. The dome-shaped transversal wall 4 showed that the inner thread structure 305 of the cap 1 continues to remain engaged with the outer thread structure 205 of the neck 201, above all at the first segments 307 which remain stably engaged with the outer thread structure 205, that is to say, with the first portions 208 thereof.

The Applicant also carried out several opening tests, in order to check in which times and with what effectiveness the pressure is discharged from the container 2, during unscrewing of the cap, and if necessary what residual pressure the container 2 contains at the end of that unscrewing.

The opening tests were carried out in a test station with accelerated unscrewing (from 120 to 180 rotations per minute) and highlighted that already before completion of a complete rotation of 360° around the axis, and therefore already before the first segments 307 have completely disengaged from the outer thread structure 205, the pressure inside the container 2 is halved. The residual pressure is substantially null after a rotation of 720° degrees around the axis, that is to say, after two turns, when both the first segments 307 and the second segments 308 have completely disengaged from the outer thread structure 205 of the neck 201.

In other words, the cap 1 according to this invention guarantees a fast and complete discharge of the pressure contained inside the container during its opening, but also an optimum and strong seal on the neck 201 before opening, even if it is subjected to stress with test pressures (during the high temperature tests) even beyond the upper pressure limits which are expected inside the container 2 in general storage conditions for the container 2 itself.

The inner thread structure 305 can comprise a single thread which extends in a spiral angularly for an angle greater than or equal to 650° and less than or equal to 900°.

In other words, if the inner thread structure 305 has a single spiral thread, the inner thread structure 305 has a single start.

The thread extends from a start, not illustrated, which is placed near the transversal wall 4, to an end, not illustrated, which is placed near the separating line 5.

If the thread extends for an angle greater than 650° and less than or equal to 720° then, the thread extends only for two turns through the first segments 307 and the second segments 308.

If, in contrast, the thread extends for an angle greater than 720° and less than or equal to 900° then the inner thread structure also comprises the third segments and the thread extends for three turns through the first segments 307, the second segments 308 and the third segments.

According to one alternative embodiment, not illustrated, the inner thread structure 305 can comprise two threads offset by 180° which extend in a spiral.

It should be noticed that each vent groove 306 is recessed for its entire axial and angular extent relative to an inner surface 310 of the closing element 302 from which the inner thread structure 305 protrudes. Indeed, at the vent groove 306, the thickness of the lateral wall 3 is reduced. This further increases the free space between the cap 1 and the neck 201, which is also determined by the radial dimensions of the vent groove 306.

In contrast, each vent passage 309 is placed on the inner surface 310 and is not recessed relative to it.

It should be noticed that, in the accompanying figures, there are six vent grooves 306 and they define six first segments 307 and six second segments 308, each of which comprises the pair of parts 308'. Therefore, in total, if there are six interruptions to the inner thread structure 305 in the first turn, due to the six grooves between the first segments 307 which are near the transversal wall 4, there are six in the second turn, due to the same six vent grooves 306 between the second segments 308 but to these it is also necessary to add the further six vent passages which interrupt the six second segments 308 making a total of twelve interruptions in the second turn (if all of the second segments 308 are interrupted by respective vent passages 309).

As already indicated, the separating line 5, and optionally the incision line, are made by means of cutting operations in the lateral wall 3. Therefore, they can be positioned in the lateral wall 3 only in the retaining ring 301 in which the inner thread structure 305 is absent.

In use, the cap 1 is applied on the neck 201 of the container 2 in the closed condition. The cap 1 is positioned in such a way that the engaging element 313 provided inside the retaining ring 301, in particular on the retaining portion 303 is below the locking ring 206 which is present on the neck 201.

When the user wishes to open the container 2 for the first time, the user grips the closing element 302 and rotates the closing element 302 around the axis Z, in order to unscrew the closing element 302 from the neck. Initially, the closing element 302 and the retaining ring 301 are rotated together around the axis Z, and they simultaneously move together in a direction parallel to the axis Z, away from the neck, the inner thread structure 305 of the cap 1 engaging with the corresponding outer thread structure 205 of the neck 201 of the container 2.

The initial rotation of the closing element 302 and of the retaining element 301 away from the neck occurs until the engaging element 313 of the retaining portion 303 abuts against the locking ring 206 provided on the neck 201. At this point, the locking ring 206 prevents the retaining portion 303 from rising further along the axis Z, acting as a stop for the movement of the retaining portion 303, and therefore of the retaining ring 301, away from the neck 201.

The closing element 302, which is unscrewed by the user, continues to move along the axis Z away from the neck and the breakable bridges 503 present on the separating line 5 are thereby tensioned, until causing them to break. Consequently, the closing element 302 separates from the retaining ring 301 along the separating line 5.

During this initial rotation of the cap 1 around the neck 201, the first segments 307 still remain engaged with the outer thread structure 205 and are subjected to stress by the whole pressure of the gas contained in the container 2. However, the first segments 307 being continuous, they apply a strong grip with the outer thread structure 205 and the cap 1 can remain stably connected to the neck 201 of the container 2.

As the vent grooves 306 of the cap 1 gradually angularly face the vent channels 207 of the neck 201, the pressurised gas can escape, that is to say, also facilitated by the recessed shape of the vent groove 306 of the cap 1 which acts as a free space for discharge of the gas between the outer surface 204 of the neck 201 and the inner surface 310 of the cap 1.

If the user continues unscrewing the closing element 302, so as to move the closing element 302 along the axis Z in order to remove it from the neck 201, the cap 1 rises relative to the upper edge 202' which surrounds the supply opening 202 of the neck 201. After the user has performed a rotation greater than 360°, the first segments 307 disengage from the coupling structure 205 of the neck and the residual pressure still contained in the container 2 subjects the second segments 308 to stress.

Through the interruptions due to the vent grooves 306 and the vent passages 309, that residual pressure is capable of completely discharging from the container 2 and the user is thereby able to remove the cap 1 from the neck 201 in complete safety.

If there are connecting bands present between the closing element 302 and the retaining ring 301, they can connect the retaining portion 303, locked by the locking ring 206, and the closing element 302, which moved away from the locking ring 206 and rose upwards, even when the closing element 302 is in the open portion in which it is no longer superposed over the supply opening 202 of the neck 201.

The cap 1 according to this invention is particularly suitable for being applied to containers 2 whose necks 201 are listed below and are identified by a code which uniquely identifies them according to the standard CETIE nomenclature. For these reference should be made to the characteristic sizes of the neck 201 supplied at the start of this description and to the E×T size to be used to indicate the angular extent of the outer thread structure 205.

Features P, T, C and X are all expressed in mm.

GME30.37

P=2.17; T=26.44, EXT=678°; C=21.74, X=12.93

GME30.40

P=2.3, T=26.44, EXT=678°, C=21.74, X=15.10

GME30.41

P=2.3, T=26.44, EXT=678°, C=21.74, X=13.4

GME30.38

P=2.5, T=26.6, EXT=505°, C=21.74, X=12

26/22 embodiment by the Applicant

P=2.17, T=25.84, EXT=630°, C=21.74, X=12

Below are the specifications of the caps 1 capable of being joined to the necks 201 specified above. PP indicates the pitch of the inner thread structure 305 defined above, EXTINT indicates the angular extent of the inner thread structure 305 around the axis Z, TH indicates the thickness of the transversal wall 4 in the axial direction, WH indicates the weight of the cap 1.

The cap 1 configured to be joined to the GME30.37 neck has the following features.

PP=2.17; EXTINT≤750°; 0.7≤TH≤1.3 mm; 1.45≤WH≤1.80 g

Alternatively 0.40≤TH≤1.00 mm; 1.10≤WH≤1.55 g

The cap 1 configured to be joined to the GME30.40 neck has the following features PP=2.3; EXTINT≤790°; 0.7≤TH≤1.3 mm; 1.45≤WH≤1.85 g Alternatively 0.40≤TH≤1.00 mm; 1.11≤WH≤1.60 g The cap 1 configured to be joined to the GME30.41 neck has the following features.

PP=2.3; EXTINT≤790°; 0.7≤TH≤1.3 mm; 1.45≤WH≤1.80 g

Alternatively 0.40≤TH≤1.00 mm; 1.11≤WH≤1.55 g

The cap 1 configured to be joined to the GME30.38 neck has the following features.

PP=2.5; EXTINT≤720°; 0.7≤TH≤1.3 mm; 1.30≤WH≤1.65 g

Alternatively 0.40≤TH≤1.00 mm; 0.80≤WH≤1.45 g

The cap 1 configured to be joined to the "26/22 embodiment" neck by the Applicant has the following features.

PP=2.17; EXTINT≤750°; 0.7≤TH≤1.3 mm; 1.30≤WH≤1.65 g

Alternatively 0.40≤TH≤1.00 mm; 0.80≤WH≤1.45 g

The cap 1, previously described is made of plastic material, for example polypropylene (PP) or polyethylene (PE).

If PE is used, its density can range from low density to high density. In particular, it is possible to use high density polyethylene (HDPE).

The high density polyethylene (HDPE) used to make the cap previously described can have the following properties:

density variable between 950 and 963 kg/m3;

melt index variable from 0.3 to 5 g, in the following measuring conditions: 10 minutes, 190° C., 2.16 kg;

molecular weight distribution wide, or narrow, or unimodal, or multimodal.

In addition, the cap 1 can also be made with recycled high density polyethylene (HDPE), if it has suitable features, for example the recycled HDPE content of the virgin material can be between 5% and 100%.

With regard to the HDPE content and the type of beverage contained in the container 2 for which the cap 1 is intended, the weight of the cap can be increased up to 200 mg and a thickness of the lateral wall 3 can be between 0.75 mm and 1.35 mm.

The density of the recycled HDPE can be for example equal to 0.954 g/cm3 but, more generally, can be as in the specifications listed below.

For example, the density can be greater than or equal to 0.930 g/cm3 and less than or equal to 0.962 g/cm3, preferably greater than or equal to 0.929 g/cm3 and less than or equal to 0.958 g/cm3.

The fluidity can be expressed as melt index and supplied with values suitable for caps for aerated beverages previously given.

For example, at 190° C./2.16 kg it can be equal to 0.8 g/10 min, whilst, at 190° C./5 kg it can be equal to 4 g/10 min.

Alternatively, at 190° C./2.16 kg it can be equal to 1.5 g/10 min whilst at 190° C./5 kg it can be equal to 7 g/10 min.

If polypropylene (PP) is used, that material can be in the form of a homopolymer, or heterophasic copolymer, or even statistical copolymer.

The melt index of polypropylene (PP) can vary from 2 to 20 g, in the following measuring conditions: 10 minutes, 230° C., 2.16 kg.

The invention claimed is:

1. A closing cap (1) for a container (2) intended to contain pressurised beverages, comprising a lateral wall (3) extending around an axis (Z) and a transversal wall (4) positioned at one end of the lateral wall (3), a separating line (5) being provided on the lateral wall (3) to define a retaining ring (301), which extends as far as a free edge (304) and is configured to engage with a locking ring (206) of a neck (201) of the container (2), and a closing element (302) removably engageable with the neck, so as to open or close the container; the cap comprising an inner thread structure, positioned on the inside of the lateral wall (3) of the closing element (302) to engage with an outer thread structure of the neck (201) and to removably couple the closing element (302) to the neck (201) of the container (2), the inner thread structure (305) extending in a spiral around the axis (Z) and comprising at least two vent grooves (306) which extend axially and interrupt the inner thread structure (305) thereby defining first segments (307), near the transversal wall (4) and second segments (308), over which the first segments (307) are axially superposed; wherein each of the first segments (307) extends angularly in a continuous way but for the vent grooves (306), and wherein at least one segment of the second segments (308) is interrupted by a vent passage (309), to facilitate the discharge of the pressure.

2. The cap according to claim 1, wherein at least two of the second segments (308) are interrupted by respective vent passages (309).

3. The cap according to claim 1, wherein all of the second segments (308) are interrupted by respective vent passages (309).

4. The cap according to claim 1, wherein the inner thread structure (305) comprises third segments, over which the second segments (308) are axially superposed;

wherein at least one segment of the third segments is interrupted by a respective vent opening which is axially aligned with the vent passage (309) of the second segment (308).

5. The cap according to claim 1, wherein the angular dimension of each of the vent grooves (306) is greater than the angular dimension of the vent passage (309).

6. The cap according to claim 1, wherein the inner thread structure (305) comprises a single thread which extends in a spiral angularly for an angle greater than or equal to 650° and less than or equal to 900° and extends from a start placed near the transversal wall (4), to an end placed near the separating line (5).

7. The cap according to claim 6, wherein the thread extends for an angle greater than or equal to 650° and less than or equal to 720° and extends through the first segments (307) and the second segments (308).

8. The cap according to claim 4, wherein the inner thread structure (305) comprises a single thread which extends in a spiral angularly for an angle greater than or equal to 650° and less than or equal to 900° and extends from a start placed near the transversal wall (4), to an end placed near the separating line (5), wherein the thread extends for an angle greater than 720° and less than or equal to 900°, and extends through the first segments (307), the second segments (308) and the third segments.

9. The cap according to claim 1, wherein each vent groove (306) is recessed relative to an inner surface (310) of the closing element (302) from which the inner thread structure (305) protrudes.

10. The cap according to claim 1, wherein each vent passage (309) is placed on an inner surface (310) of the closing element (302) from which the inner thread structure (305) protrudes.

11. The cap according to claim 1, wherein there are six vent grooves (306) and they define six first segments (307) and six second segments (308).

12. The cap according to claim 4, wherein the angular dimension of each of the vent grooves (306) is greater than the angular dimension of the vent opening.

* * * * *